US005269163A

United States Patent [19]

Yagi et al.

[11] Patent Number: 5,269,163

[45] Date of Patent: Dec. 14, 1993

[54] DEVICE FOR CORRECTING DIE SPACING AT BOTTOM DEAD CENTER OF A PRESS

[75] Inventors: Takashi Yagi; Shozo Imanishi, both of Sagamihara, Japan

[73] Assignee: AIDA Engineering Ltd., Kanagawa, Japan

[21] Appl. No.: 906,288

[22] Filed: Jun. 29, 1992

[30] Foreign Application Priority Data

Jun. 28, 1991 [JP] Japan ..... 3-157929

[51] Int. Cl.[5] ..... B21J 7/40

[52] U.S. Cl. ..... 72/21; 72/441; 72/446; 100/99; 100/53

[58] Field of Search ..... 72/21, 441, 446; 310/328, 318, 338; 100/257, 258 R, 258 A, 99, 53

[56] References Cited

U.S. PATENT DOCUMENTS

| | | | |
|---|---|---|---|
| 3,196,647 | 7/1965 | Schneider | 72/21 |
| 3,473,466 | 10/1969 | Thayer | 310/328 |
| 3,952,215 | 4/1976 | Sakitani | 310/328 |
| 4,377,084 | 3/1983 | Kaminski | 72/325 |
| 4,531,901 | 7/1985 | Andersen | 72/21 |
| 4,622,484 | 11/1986 | Okihara et al. | 310/328 |
| 4,676,090 | 6/1987 | Nishimura et al. | 100/257 |
| 5,095,725 | 3/1992 | Wada et al. | 310/328 |
| 5,113,756 | 5/1992 | Fujii | 72/446 |

FOREIGN PATENT DOCUMENTS

| | | | |
|---|---|---|---|
| 0126932 | 6/1986 | Japan | 72/21 |
| 0169200 | 7/1986 | Japan | 100/99 |
| 1-30569 | 6/1989 | Japan . | |
| 0255298 | 10/1990 | Japan | 100/99 |

*Primary Examiner*—Lowell A. Larson
*Assistant Examiner*—Michael J. McKeon
*Attorney, Agent, or Firm*—Steven M. Rabin

[57] ABSTRACT

An apparatus for use with a press which corrects the spacing between an upper die and a lower die when the press is at bottom dead center. The apparatus includes a detector which is operative during each cycle of reciprocal movement of the press slide to detect the spacing between the upper and lower dies, a comparator which compares the detected spacing during each cycle with a prior spacing, an axially expansible/contractible piezoelectric actuator mounted on the press so that its axial length affects the spacing between the upper and lower dies when the press is at bottom dead center, and a drive circuit which is responsive to a deviation signal from the comparator to drive the actuator with a high voltage so as to expand or contract its axial length according to the difference between the detected and prior spacing of the dies.

8 Claims, 2 Drawing Sheets

DEVICE FOR CORRECTING DIE SPACING AT BOTTOM DEAD CENTER OF A PRESS

CROSS-REFERENCE TO RELATED APPLICATION

This application claims the priority of Japanese patent application No. 3-157929 filed Jun. 28th, 1991, the disclosure of which is incorporated herein by reference.

BACKGROUND OF THE INVENTION

The invention relates to an apparatus for correcting the spacing between upper and lower dies of a press at the bottom dead center, and more particularly, to an apparatus for automatically correcting the spacing of such dies by expansion and contraction of a piezoelectric actuator.

In a press having dies, including an upper die mounted to a slide and a lower die mounted to a bolster, pressing operations are performed by moving a slide up and down using a crankshaft or the like. It is known that in such a press the spacing of the dies at bottom dead center may change due to a change in temperature. It is not acceptable to leave such a change uncorrected because the change will worsen the accuracy with which products are pressed.

A conventional approach to reducing the change in die spacing at bottom dead center is to pour oil, which is controlled at a given temperature, over the connecting rod, as disclosed in Japanese Patent Pub. No. 1-30569. Another approach is to change the rigidity of a stopper block interposed between the slide and the bolster, as disclosed in Japanese Patent Pub. No. 1-55056 and its U.S. counterpart, U.S. Pat. No. 4,377,084.

The former approach, however, requires an oil temperature controlling unit and, moreover, with this approach it is difficult to quantitatively adjust the die spacing at bottom dead center. With the latter approach, one must select a stopper block of an appropriate rigidity for the particular press load and press machine.

SUMMARY OF THE INVENTION

An object of the invention is to provide a bottom dead center correcting apparatus for a press, which can correct automatically and accurately the die spacing at bottom dead center while the press is in operation.

The apparatus according to the invention is disposed either between members provided on the slide or bolster side, or between the slide-side member and the side portion of bolster. The apparatus includes an axially expansible/contractible piezoelectric actuator, a piezoelectric drive means for applying a high voltage to the actuator so as to force it to expand or contract, a means for setting the die spacing at bottom dead center, a means for detecting the die spacing at bottom dead center, and a signal comparator for providing a deviation signal upon comparison of a signal from the setting means indicating the die spacing set for bottom dead center with a signal from the detecting means indicating the actual die spacing. The piezoelectric drive means operates in response to the deviation signal to automatically adjust the piezoelectric actuator in its expansion or contraction, whereby a change in the die spacing at bottom dead center can be automatically corrected.

When, during the pressing operation, there occurs a temperature change which would cause a change in the die spacing at bottom dead center, the change in spacing is automatically detected by the detecting means. The signal comparator then compares the signal from the setting means with the signal from the detecting means and emits a deviation signal according to the magnitude and sign of the difference. Depending upon the deviation signal emitted, the piezoelectric drive means operates to expand or contract the piezoelectric actuator.

By this arrangement, a clearance between a member on which the piezoelectric actuator is mounted, and an opposing member, is so adjusted as to correct the change in the die spacing at bottom dead center, thereby enabling the apparatus to automatically correct the die spacing at bottom dead center on a real time basis.

BRIEF DESCRIPTION OF THE DRAWINGS

These and other features and advantages of the invention will be further understood from the following detailed description of the preferred embodiments with reference to the accompanying drawings in which.

DETAILED DESCRIPTION OF THE PREFERRED EMBODIMENTS

Figure 1:
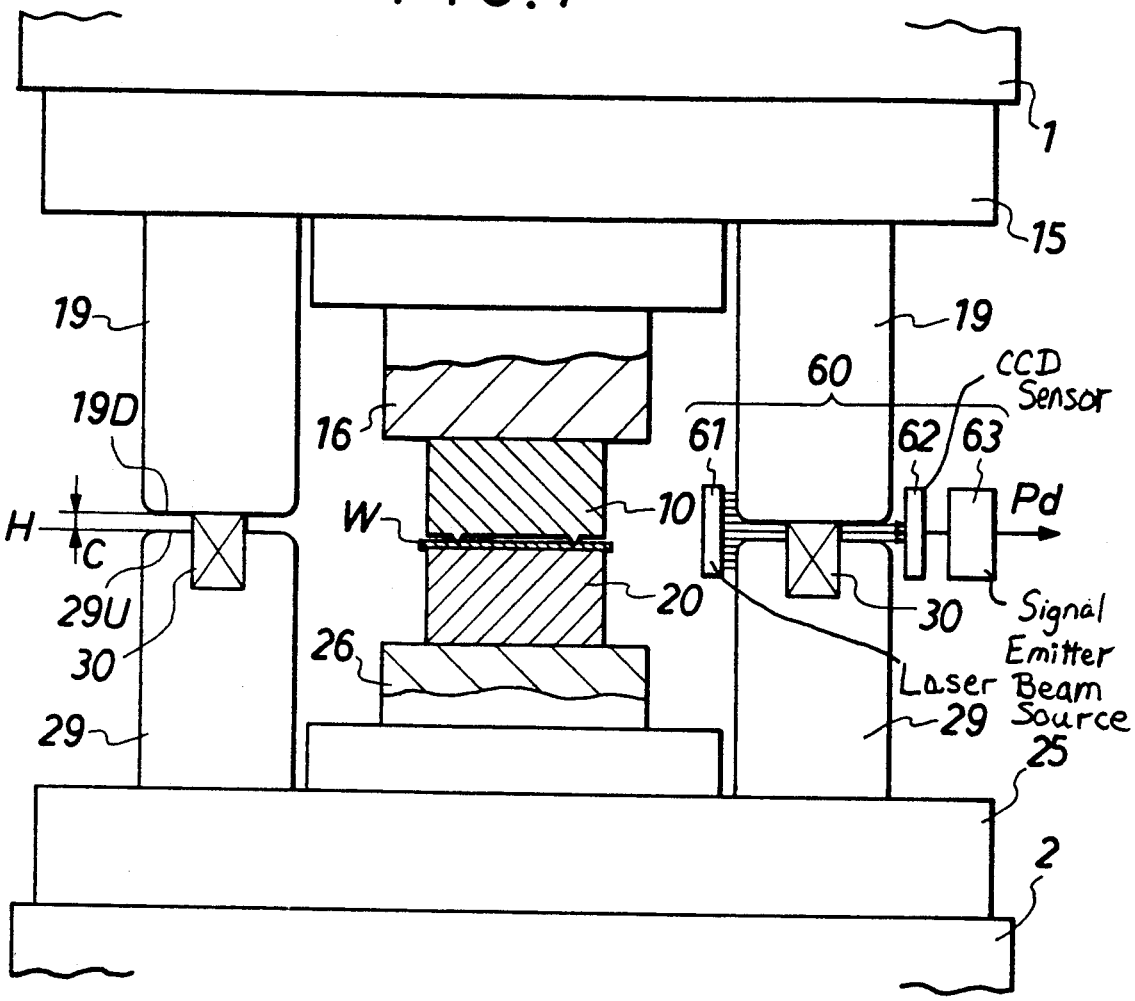
FIG. 1 is a sectional side elevation of the press, bottom dead center detector and piezoelectric actuator, according to a preferred embodiment of the invention.

The press machine provided with the bottom dead center correcting apparatus will be described with reference to FIG. 1. Reference numeral 1 designates a slide adapted to be reciprocated vertically by a crankshaft. Reference numeral 2 designates a bolster mounted to a bed (not illustrated). An upper die 10 is fixed to the slide by an upper die plate 15 and an upper die holder 16. Reference numeral 11 designates a grooving portion of the upper die 10. A lower die 20 is fixed to the bolster by a lower die plate 25 and a lower die holder 26.

Figure 3:
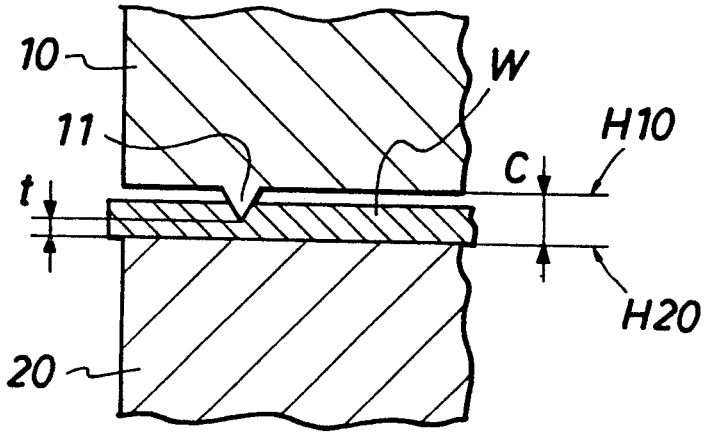
FIG. 3 is an enlarged view of the dies and a pressed workpiece showing the relation between the pressed workpiece and the dies at the bottom dead center position of the press.

The embodiment, as shown in FIG. 3, is to form a groove in a workpiece W such that the workpiece is left with a reduced thickness t at the bottom of the groove. Therefore, if the lower die 20 has its upper surface at H20, the upper die 10 at bottom dead center must have its lower surface at H10, that is, spaced from the upper surface of the lower die 20 by a predetermined constant clearance C.

As shown in FIG. 1, the embodiment further comprises upper stopper blocks 19 provided with the slide 1 and lower stopper blocks 29 provided with the bolster 2, so as to maintain the clearance C between the dies 10 and 20 at bottom dead center.

According to the illustrated preferred embodiment, the opposing stopper blocks 19 and 29 have the clearance C between them when the dies 10 and 20 are separated by the clearance C. The clearance C between the upper and lower dies at bottom dead center is secured by piezoelectric actuators 30. This arrangement is effective to stabilize control properties of a piezoelectric drive circuit 40 and make them highly sensitive, as will be explained below.

Figure 2:
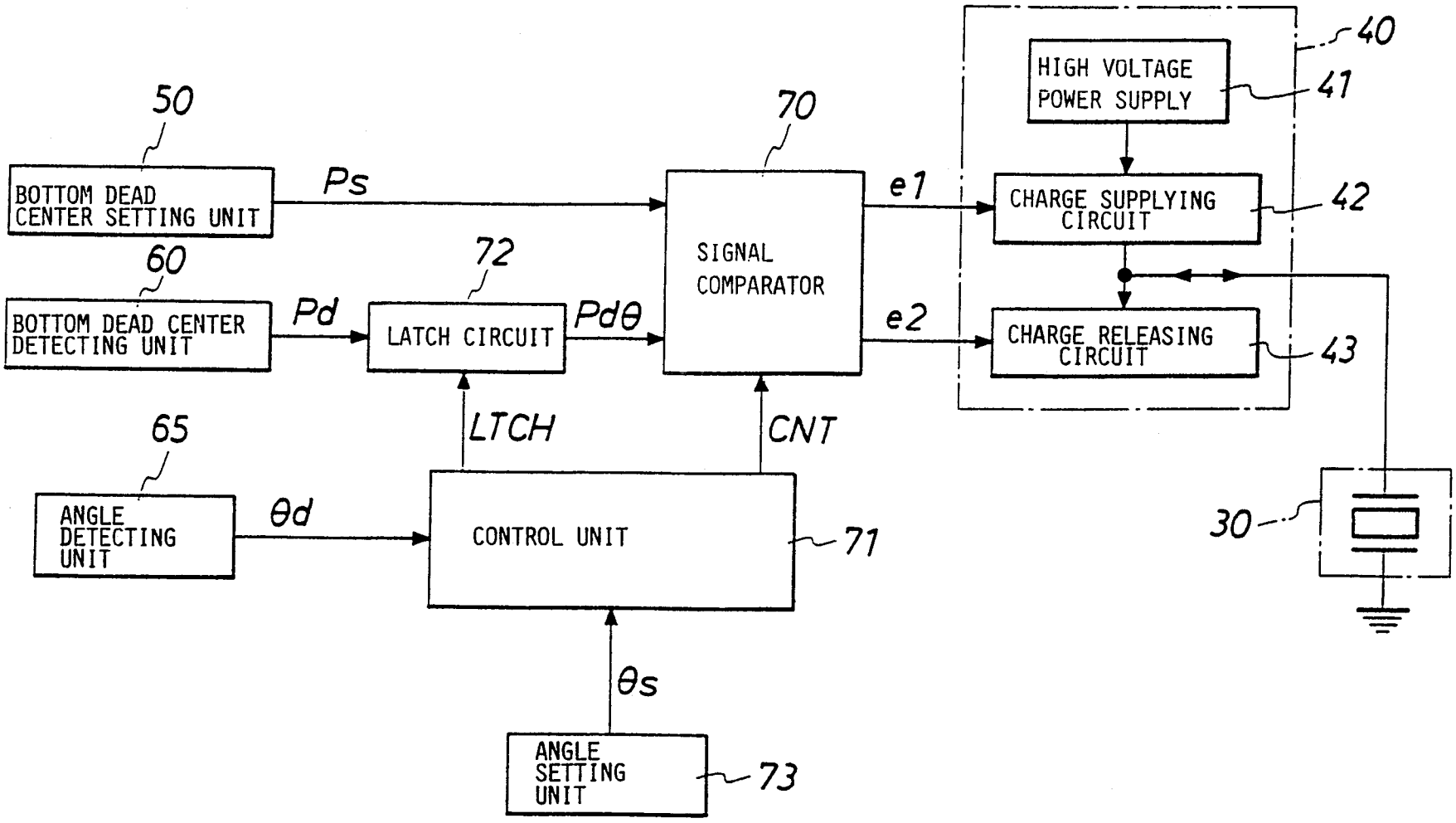
FIG. 2 is a block diagram of the preferred embodiment of the bottom dead center correcting apparatus according to a invention.

As shown in FIGS. 1 and 2, the bottom dead center die spacing correction apparatus of the invention includes piezoelectric actuators 30, a piezoelectric drive circuit 40, a signal comparator 70, a bottom dead center setting unit 50 and a bottom dead center detecting unit 60. The apparatus is arranged to automatically correct the change in the die spacing at bottom dead center by adjusting the piezoelectric actuator to expand or contract. The piezoelectric actuator 30 is a device which will exert the so-called piezoelectric effect; i.e., it expands or contracts axially (vertically in FIG. 1), when subjected to a high voltage.

The piezoelectric actuator 30 according to the illustrated embodiment is disposed between the stopper blocks 19 and 29. Specifically, the actuator 30 with its lower end fixed to the lower stopper blocks 29 corrects the change in the die spacing at bottom dead center, regarding its upper surface H as the criterion.

More specifically, the piezoelectric actuator 30 comprises laminated ceramics having 1,100 kgf at the maximum, a deformation (expansion/contraction) of 60 μm at $-100\sim+500$ V, the deformation occurring with a high speed within a response time of less than 100 μsec, and a high resolution less than 100 μm. The embodiment is provided with six such actuators, more or less, according to the press load.

As shown in FIG. 2, the piezoelectric drive circuit 40 comprises a high voltage power supply 41, a charge supplying circuit 42 for supplying an electric charge to the actuators and a charge releasing circuit 43 for releasing the charge. The piezoelectric drive circuit 40, in response to a deviation signal e1, supplies electric charge to the actuator 30 to elongate it and, in response to a deviation signal e2, releases charge from the actuator 30 to contract it. The deviation signals e1 and e2 are of opposite polarities. The high voltage power supply 41 is capable of generating voltages from $-100$ to $+500$ V. The bottom dead center setting unit 50 sets the spacing of the dies at bottom dead center indirectly by setting the clearance C between the stopper blocks 19 and 29, which clearance corresponds with the desired spacing between the upper die 10 and the lower die 20. The setting unit 50 includes digital switches with which to output a signal Ps indicating the set die spacing at bottom dead center.

On the other hand, a bottom dead center detecting unit 60 comprises a laser beam source 61, a CCD sensor 62 and a deviation signal emitter 63. The resolution of the unit 60 is $0.1\sim0.5$ μm.

The bottom dead center detecting unit 60 detects the die spacing at bottom dead center indirectly by detecting the clearance between the stopper blocks 19 and 29 and provides a signal Pd corresponding thereto. Therefore, if the dies are detected to be apart from each other at bottom dead center by the predetermined clearance C, the signal Pd from the emitter 63 indicating the actual spacing at bottom dead center will have the same value as the signal Ps indicating the die spacing set by the setting unit 50.

As shown in FIG. 2, in the preferred embodiment, the output of the detecting unit 60 provides a continuous indication of the actual clearance between the stopper blocks 19 and 29. The signal comparator 70 compares the output of the detecting unit 60 to that of the setting unit 50 in response to a control signal CNT from a control circuit 71 when, at the same time, the output of the detecting unit is passed through to the comparator 70 by a latch circuit 72 in response to a latch signal LTCH from the control circuit 71.

In the preferred embodiment, the comparison is made shortly before the press reaches bottom dead center. This permits corrective action to be taken in time to correct the spacing when bottom dead center is reached in the current press cycle, i.e., before the upper stopper block contacts the actuator 30. Also, making the comparison at that earlier time, as compared to just after the press reaches bottom dead center, which is ordinarily just after the upper stopper block 19 contacts the actuator 30, permits a quantitatively more accurate determination to be made of a change in die spacing.

Before pressing operations have been initiated, so that temperature conditions have not caused parts to expand and change the die spacing at bottom dead center, the die spacing is correlated precisely with the angle $\theta$ of the press's crankshaft. Thus, initially, the set clearance C at bottom dead center is correlated with a specific crankshaft angle $\theta$sp. An angle detecting unit 65 provides a continuous output of the detected crankshaft angle $\theta$d in the form of a detected angle signal. The comparison of the set and detected values of clearance between the stopper blocks is therefore established for when the detected angle $\theta$d is slightly less than 74 sp, that is equal to a set crank angle $\theta s=\theta sp-\Delta\theta$ which at the start of pressing operation corresponds to a die clearance of $C+\Delta C$, where the extra amount of clearance $\Delta C$ corresponds to the decrement of crank angle $\Delta\theta$. An angle setting unit 73 provides the set crank angle $\theta$s to the control unit 71 and the angle detecting unit 65 provides the detected crankshaft angle $\theta$d to the control unit 71. The control unit 71 outputs the latch signal LTCH and the control signal CNT when $\theta d=\theta s$ so that the latch circuit 72 outputs a signal Pd$\theta$ (Pd for $\theta d=74$ s) to the signal comparator 70. The comparator 70 then compares Pd$\theta$ to Ps and outputs a deviation signal e1 or e2 as appropriate (the deviation signal e1 for expansion in case of $Ps>Pd\theta$ or the deviation signal e2 for contraction in case of $Ps<Pd\theta$). The deviation signal is delivered to the piezoelectric drive circuit which will in turn apply a suitable voltage to the actuator 30 to correct the die spacing at bottom dead center in the current cycle of the press.

Now, a typical operation of the apparatus will be described hereinbelow. By using a slide adjusting device, the position of the slide 1 is adjusted so that the upper die 10 and lower die 20 are apart from each other by the clearance $C+\Delta C$. At this time, the stopper blocks 19 and 29 are also apart from each other by the clearance $C+\Delta C$ so that the upper stopper block 19 is spaced by only the increment $\Delta C$ from the piezoelectric actuator 30. Thus, these stopper blocks together with the actuator 30 can function as a stopper when the press is at bottom dead center.

With the slide 1 in the above-described adjusted position, the desired clearance C indirectly indicating the spacing of the dies at bottom dead center is set using the bottom dead center setting unit 50 to establish the set die spacing signal Ps corresponding to the clearance $C+\Delta C$. Further, the crank angle $\theta s=\theta sp-\Delta\theta$, wherein $\theta$sp corresponds to the bottom dead center clearance C and $\Delta\theta$ corresponds to $\Delta C$, is set in the angle setting unit 73. In this case, the signal Pd from the detecting unit 60, indicating the detected die spacing, is so adjusted that when the crank angle is $\theta$s, the signal $Pd=Pd\theta$ is equivalent to the die spacing signal Ps.

During the pressing operations, the control unit 71 emits the latch signal LTCH when the crank angle $\theta d$ as detected by the detecting unit 65 corresponds with the set crank angle $\theta s$. This causes the latch circuit 72 to latch the signal Pd from the detecting unit 60 as the signal $Pd\theta$. At the same time the control unit 71 emits the control signal CNT to the signal comparator 70, whereupon the comparator 70 compares the set die spacing signal Ps with the latched signal $Pd\theta$.

In the usual case, for the first several cycles of the pressing operation, the signals Ps and $Pd\theta$ will be equal because there will be no temperature change. Therefore, no deviation signals e1 or e2 will be emitted by the comparator 70. Consequently, the desired clearance C between the dies 10 and 20 at bottom dead center is maintained and the workpieces are pressed with a predetermined accuracy.

As the pressing operation proceeds, the temperature increases, which, but for the invention, would cause changes in die spacing at bottom dead center to occur. When the crank angle $\theta d$ detected by the angle detecting unit 65 corresponds with the crank angle $\theta s$ $(=\theta sp-\Delta\theta)$ set by the angle setting unit 73, the upper die 10 comes lower than previously ($\Delta Cd$ lower), thereby changing the clearance anticipated for bottom dead center to $C+\Delta C-\Delta Cd$. In this case, the signal Ps from the setting unit 50 still equals $C+\Delta C$ while the signal $Pd\theta$ from the detecting unit 60 equals $C+\Delta C-\Delta Cd$, thereby resulting in the relation $Pd\theta<Ps$. If the pressing machine were to remain in this condition without correction, the predetermined clearance between the dies, and therefore the desired accuracy of the pressing operation on the workpieces, would not be maintained.

According to the invention, the signal comparator 70 outputs the deviation signal for expansion e1 to the charge supplying circuit 42 of the piezoelectric drive circuit 40. In response to the signal e1, the circuit 42 supplies to the piezoelectric actuator 30 an electric charge appropriate to eliminate the above $\Delta Cd$ reduction in die spacing by axial expansion of the actuator 30. Consequently, the piezoelectric actuator 30 elongates upward in FIG. 1 so that the temperature-induced change in the die spacing at bottom dead center is corrected automatically and thus the predetermined clearance C is maintained. This correction is initiated every time the detected crank angle $\theta d$ coincides with the set crank angle $\theta s$.

If there subsequently occurs an abrupt drop in room temperature where the pressing machine is installed, a temporary stoppage of pressing operations, or a reduction in pressing rate due to a change in operating voltage, the detected die spacing may increase, thereby resulting in the following relationship between successive signals $Pd\theta$: $Pd\theta_i<Pd\theta_{i+1}$. In other words, the value $Ps-P\theta d_{i+1}$, which is the difference between the current signal latched from the detecting unit 60, i.e. $Pd\theta_{i+1}$, and the signal Ps from the setting unit 50, becomes smaller than the preceding difference $Ps-Pd\theta_i$. Therefore, the value of the deviation signal e1 emitted by the comparator 70 is reduced, whereby the piezoelectric actuator 30 somewhat contracts.

Consequently, the invention can maintain a constant clearance between the dies 10 and 20 at bottom dead center through an extended period of operation and under varying conditions.

The invention now being fully described, it will be apparent to one of ordinary skill in the art that any changes and modifications can be made thereto without departing from the spirit or scope of the invention as set forth herein. For example, alternative embodiments are contemplated in which one or more piezoelectric actuators 30 are disposed between members incorporated on the slide side of the press, between members incorporated on the bolster side, or between vertically divided parts of the lower stopper block 29. Slide-side disposed piezoelectric actuators can be mounted between the slide 1 and the upper die plate 15, between the upper die plate 15 and the upper die holder 16, or between the upper die holder 16 and the upper die 10. If piezoelectric actuators are disposed on the bolster side, they can be mounted between the lower stopper blocks 29 and the lower die plate 25, or between the lower die plate 25 and the bolster 2. With the actuators mounted in this way, the press can be so constructed that the lower surfaces 19D of the upper stopper blocks 19 contact the upper surfaces 29U of the lower stopper blocks 29 when the dies 10 and 20 have the clearance C between them.

The bottom dead center detecting unit 60 according to the invention also may be composed of a piezoelectric element disposed between the stopper blocks 19 and 29, in which case the stress value generated therein would be used to indirectly detect the change in the die spacing at bottom dead center. In that case, the crank angle signal $\theta s$ to be set in the setting unit 73 and the die spacing signal Ps set by the setting unit 50 should be based on the desired clearance C rather than $C+\Delta C$.

What is claimed is:

1. Apparatus for use with a press having a bolster, a slide reciprocally moved toward and away from the bolster by a crankshaft, an upper die on the slide and a lower die on the bolster, said apparatus for automatically correcting a spacing between the upper die and the lower die when the press is at bottom dead center, said apparatus comprising:

means for setting a desired spacing between the upper and lower dies at bottom dead center and providing a set spacing signal indicative of the set spacing;

means for detecting the spacing between the upper and lower dies at bottom dead center and providing a detected spacing signal indicative of the detected spacing;

means for comparing the set spacing signal with the detected spacing signal and providing a deviation signal indicative of the difference between the set spacing and the detected spacing;

a piezoelectric actuator adapted for mounting on the press such that its axial length affects the spacing between the upper die and the lower die when the press is at bottom dead center, said actuator being axially expansible/contractible in response to applications of voltage thereto; and means, responsive to said deviation signal, for driving said actuator with a voltage to expand or contract its axial length by an amount corresponding to the difference between the set spacing and the detected spacing.

2. In a press apparatus including a press having a bolster, a slide reciprocally moved toward and away from the bolster by a crankshaft, an upper die on the slide and a lower die on the bolster, and means for limiting changes in a spacing between the upper die and the lower die at the bottom dead center of the press, the improvement wherein the means for limiting changes comprises:

a piezoelectric actuator mounted on said press such that its axial length affects the spacing between the upper die and the lower die at bottom dead center, said actuator being axially expansible/contractible in response to an application of voltage thereto;

means for setting a desired spacing between the upper and lower dies at a predetermined position of the slide in its reciprocal movement;

means for detecting the spacing between the upper and lower dies at said predetermined position of the slide; and means for comparing the set spacing with the detected spacing and driving said actuator with a voltage to expand or contract its axial length by an amount which depends on the comparison.

3. A press apparatus according to claim 2, wherein said means for setting a desired spacing provides a set spacing signal indicative of the set spacing, said means for detecting the spacing between the upper and lower dies providing a detected spacing signal indicative of the detected spacing, said means for comparing and driving including means for providing a deviation signal indicative of the difference between the set spacing and the detected spacing, and means, responsive to said deviation signal, for driving said actuator with a voltage to expand or contract its axial length by an amount corresponding to the difference between the set spacing and the detected spacing, thereby to automatically correct the spacing between the upper die and the lower die when the press is at bottom dead center.

4. A press apparatus according to claim 3, further comprising a first stopper block mounted to a lower surface of said slide, and a second stopper block mounted to an upper surface of said bolster so as to oppose said first stopper block, said actuator being interposed between said first and second stopper blocks.

5. A press apparatus according to claim 2, further comprising slide position detecting means, operable during the reciprocal movement of the slide, for detecting that the slide is at said predetermined position, said comparing and driving means driving said actuator with a voltage to expand or contract its length when said slide position detecting means detects, during the reciprocal movement of the slide, that said slide is at said predetermined position.

6. An apparatus according to claim 5, wherein said slide position detecting means includes means for detecting the angular position of said crankshaft.

7. An apparatus according to claim 1, further comprising slide position detecting means, operable during the reciprocal movement of the slide, for detecting that the slide is at a predetermined position near bottom dead center, said means for driving being operable, during the reciprocal movement of the slide, to expand or contract the actuator in response to said deviation signal, when slide position detecting means detects that said slide is at said predetermined position.

8. An apparatus according to claim 7, wherein said slide position detecting means includes means for detecting the angular position of said crankshaft.

* * * * *